US010020622B2

(12) United States Patent
Ebisawa

(10) Patent No.: US 10,020,622 B2
(45) Date of Patent: Jul. 10, 2018

(54) CONNECTOR

(71) Applicant: JAPAN AVIATION ELECTRONICS INDUSTRY, LIMITED, Shibuya-ku, Tokyo (JP)

(72) Inventor: Takeshi Ebisawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 22 days.

(21) Appl. No.: 15/327,506

(22) PCT Filed: Jun. 18, 2015

(86) PCT No.: PCT/JP2015/067555

§ 371 (c)(1),
(2) Date: Jan. 19, 2017

(87) PCT Pub. No.: WO2016/017314

PCT Pub. Date: Feb. 4, 2016

(65) Prior Publication Data

US 2018/0026412 A1 Jan. 25, 2018

(30) Foreign Application Priority Data

Jul. 29, 2014 (JP) ..... 2014-153465

(51) Int. Cl.
*H01R 24/76* (2011.01)
*H01R 12/73* (2011.01)
(Continued)

(52) U.S. Cl.
CPC ..... *H01R 25/162* (2013.01); *H01R 24/76* (2013.01); *H01R 2103/00* (2013.01)

(58) Field of Classification Search
CPC .. H01R 12/716; H01R 12/73; H01R 2103/00; H01R 24/76; H01R 25/162; H01R 4/34; H01R 13/113; H01R 13/187
See application file for complete search history.

(56) References Cited

U.S. PATENT DOCUMENTS 5,772,452 A 6/1998 Aoyama
7,581,972 B2 * 9/2009 Daamen ..... H01R 13/6315 439/249
(Continued)

FOREIGN PATENT DOCUMENTS

JP 60125786 U 8/1985
JP 61029480 U 2/1986
(Continued)

OTHER PUBLICATIONS

International Search Report (ISR) and Written Opinion dated Jul. 21, 2015 issued in International Application No. PCT/JP2015/067555.

*Primary Examiner* — James Harvey
*Assistant Examiner* — Matthew T Dzierzynski
(74) *Attorney, Agent, or Firm* — Holtz, Holtz & Volek PC

(57) ABSTRACT

A connector, fixable to first and second bus bars having different electric potentials and mateable with a mating connector, includes an insulator accommodation member and first and second contacts. The accommodation member has first and second surfaces opposite each other in a predetermined direction perpendicular to a mating direction, and accommodates the contacts in a pitch direction perpendicular to the mating and predetermined directions. Under a fixed state, screwed portions of the first and second contacts are either flush with, or project outward beyond, the first and second surfaces, respectively, in the predetermined direction. Under the fixed state, the first and second contacts are screwed to the first and second bus bars, respectively, by first and second screws, respectively, inserted in screw holes thereof, and the screwed portions of the first and second contacts are in direct contact with the first and second bus bars, respectively.

13 Claims, 12 Drawing Sheets

(51) Int. Cl.

| | |
|---|---|
| ***H01R 25/16*** | (2006.01) |
| *H01R 13/187* | (2006.01) |
| *H01R 103/00* | (2006.01) |

(56) References Cited

U.S. PATENT DOCUMENTS

| | | | | |
|---|---|---|---|---|
| 8,388,389 | B2 * | 3/2013 | Costello | H01R 13/18 439/637 |
| 8,403,707 | B2 * | 3/2013 | Tai | H01R 13/516 439/397 |
| 9,136,652 | B2 * | 9/2015 | Ngo | H01R 24/00 |
| 9,331,409 | B2 * | 5/2016 | Naganuma | H01R 12/7047 |
| 9,800,004 | B1 * | 10/2017 | Schepis | H01R 25/162 |

FOREIGN PATENT DOCUMENTS

| | | | |
|---|---|---|---|
| JP | 61107177 | U | 7/1986 |
| JP | 07193947 | A | 7/1995 |
| JP | 08330032 | A | 12/1996 |
| JP | 11111355 | A | 4/1999 |
| JP | 2001076784 | A | 3/2001 |
| JP | 2013218837 | A | 10/2013 |

* cited by examiner

CONNECTOR

TECHNICAL FIELD

This invention relates to a connector which is fixed to bus bar when used and which is mateable with a mating connector.

BACKGROUND ART

For example, Patent Document 1 discloses an electric connection case which comprises two bus bars.

Referring to FIG. 23, the electric connection case of Patent Document 1 comprises an upper case 910, a lower case 920 and two bus bars 930. The bus bars 930 are provided in the upper case 910 and the lower case 920, respectively. The bus bars 930 have connection terminals, namely female-to-male terminals 940 and male-to-female terminals 950, attached thereto. The connection terminals are used for connection to unillustrated connection objects such as a fuse, a relay and a connector. Moreover, each of the upper case 910 and the lower case 920 is formed with various connection portions which have shapes corresponding to the connection objects, respectively. For example, the lower case 920 is formed with a connector-insertion portion 960 which works as a connection portion for a connector. Two of the male-to-female terminals 950 are arranged within the connector-insertion portion 960.

PRIOR ART DOCUMENTS

Patent Document(s)

Patent Document 1: JP A H07-193947

SUMMARY OF INVENTION

Technical Problem

As for the electric connection case of Patent Document 1, the shape of the upper case 910 or the lower case 920 needs to be changed according to a connection object. In addition, the bus bar 930 needs to be attached with such connection terminal that corresponds to the connection object. Therefore, it is not easy to connect a required connection object to the bus bar 930.

It is therefore an object of the present invention to provide a connector which is connectable to a connection object via a mating connector and which is easily fixable to a bus bar.

Solution to Problem

An aspect of the present invention provides a connector which is fixable to two bus bars consisting of a first bus bar and a second bus bar having electric potentials different from each other and which is mateable with a mating connector along a mating direction under a fixed state where the connector is fixed to the bus bars. The connector comprises an accommodation member made of insulator and two contacts consisting of a first contact and a second contact. The accommodation member has a first surface and a second surface which are positioned opposite to each other in a predetermined direction perpendicular to the mating direction. The accommodation member accommodates the contacts which are arranged in a pitch direction perpendicular to both the mating direction and the predetermined direction. Each of the contacts has a screwed portion formed with a screw hole. Under the fixed state, the screwed portion of the first contact is flush with the first surface in the predetermined direction or projects outward beyond the first surface in the predetermined direction, and the screwed portion of the second contact is flush with the second surface in the predetermined direction or projects outward beyond the second surface in the predetermined direction. Under the fixed state, the first contact is screwed to the first bus bar by a first screw inserted in the screw hole thereof, and the second contact is screwed to the second bus bar by a second screw inserted in the screw hole thereof. Under the fixed state, the screwed portion of the first contact is in direct contact with the first bus bar, and the screwed portion of the second contact is in direct contact with the second bus bar.

Advantageous Effects of Invention

According to the present invention, the connector is mateable with the mating connector. Therefore, the connector can be connected to a connection object via the mating connector by connecting the connection object to the mating connector. Moreover, the connector has the contact formed with the screw hole. The contact can be screwed to the bus bar by the screw inserted in the screw hole thereof. Therefore, the contact can be easily fixed to the bus bar by a simple operation in which the contact is screwed to the bus bar.

An appreciation of the objectives of the present invention and a more complete understanding of its structure may be had by studying the following description of the preferred embodiment and by referring to the accompanying drawings.

DESCRIPTION OF EMBODIMENTS

Figure 1:
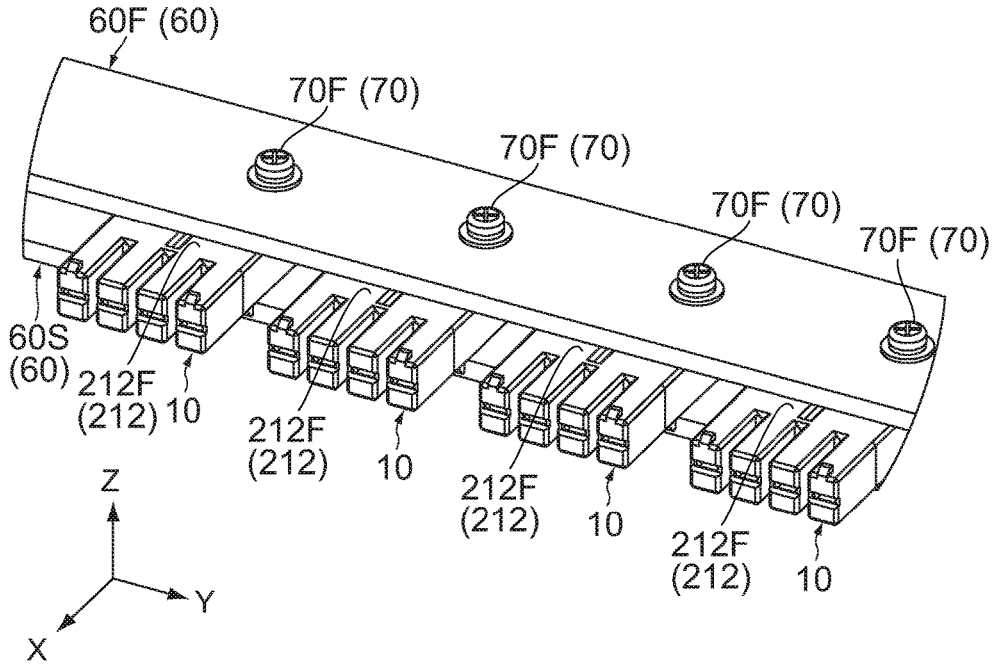
FIG. 1 is a perspective view showing a plurality of connectors and bus bars according to an embodiment of the present invention, wherein each of the connectors is under a fixed state where the connector is fixed to a first bus bar and a second bus bar.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

As shown in FIGS. 1 to 4, a connector 10 according to an embodiment of the present invention is fixable to two bus bars 60. The bus bars 60 consist of a first bus bar 60F and a second bus bar 60S having electric potentials different from each other. In the present embodiment, the bus bars 60 are connected to an AC-DC converter (not shown), and the potential difference between the two bus bars 60 is 12 V. However, each of the bus bars 60 may have any electric potential.

As can be seen from FIGS. 1 to 4, the bus bars 60 have shapes and sizes same as each other. Specifically, the bus bar 60 has a flat-plate shape in parallel to the XY-plane. Moreover, the bus bar 60 extends long in a pitch direction (Y-direction). However, the bus bar 60 may be arranged differently. For example, the bus bar 60 may be arranged in parallel to the XZ-plane to extend long in the Z-direction. Moreover, the bus bar 60 may have another shape different from that of the present embodiment, provided that the connector 10 can be sandwiched in a predetermined direction (Z-direction, upper-lower direction) to be fixed. For example, the bus bars 60 may have shapes different from each other.

Figure 2:
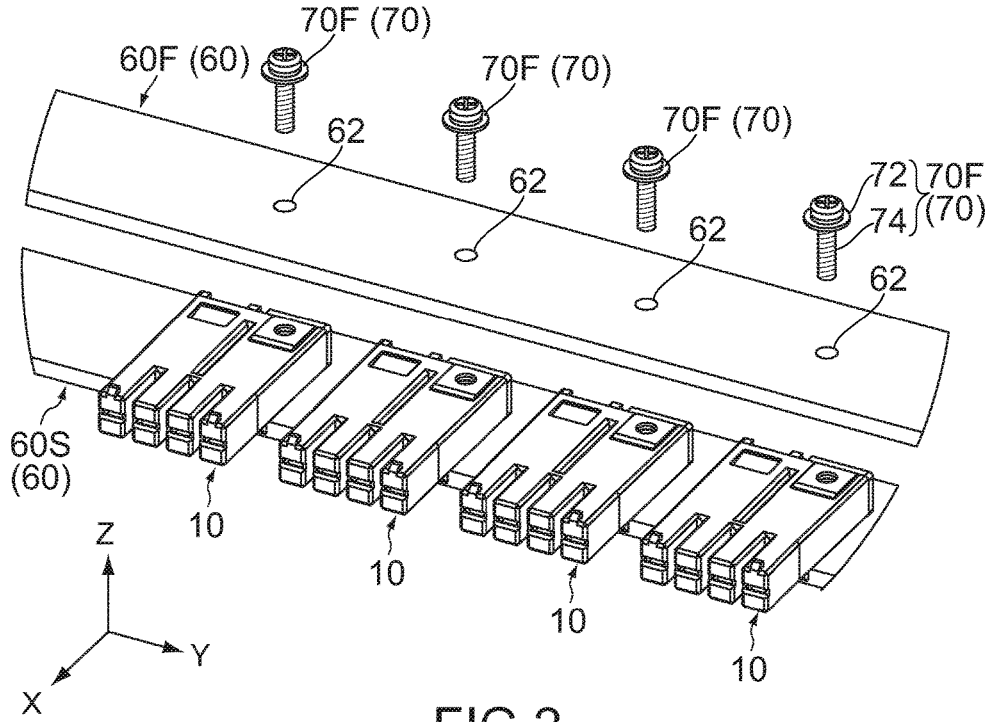
FIG. 2 is a perspective view showing the plurality of connectors and the bus bars of FIG. 1, wherein each of the connectors is placed on the second bus bar but is not fixed to any of the first bus bar and the second bus bar.
Figure 4:
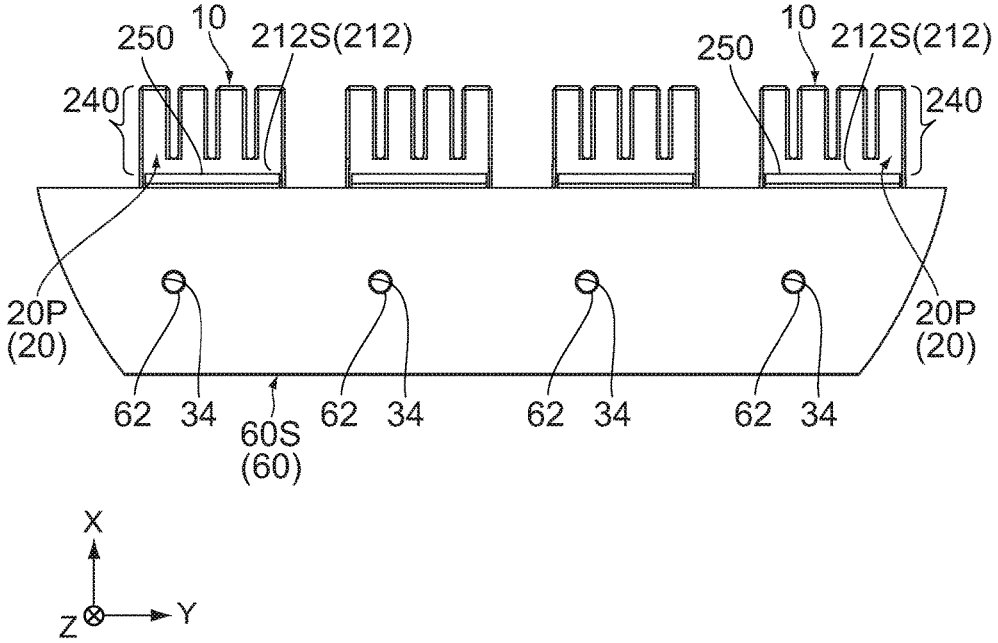
FIG. 4 is a bottom view showing the plurality of connectors and the bus bars of FIG. 2.

As shown in FIGS. 2 and 4, each of the bus bars 60 is formed with a plurality of fixing holes 62. The fixing holes 62 are holes which pierce the bus bar 60 in the Z-direction so that screws 70 pass therethrough, respectively. As can be seen from FIGS. 2 and 4, under a fixed state where the connector 10 is fixed to the bus bars 60, a position of the fixing hole 62 of the first bus bar 60F in the Y-direction is different from another position of the fixing hole 62 of the second bus bar 60S in the Y-direction.

Figure 3:
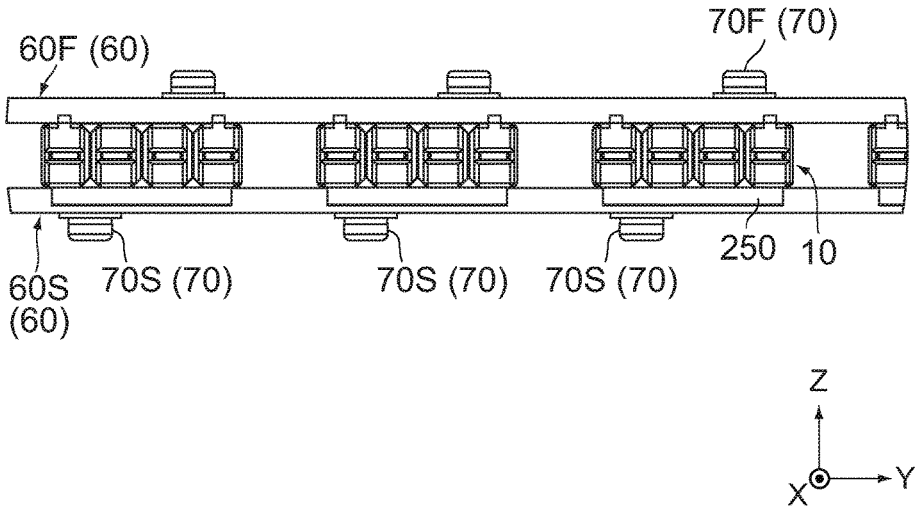
FIG. 3 is a front view showing the plurality of connectors and the bus bars of FIG. 1.

As shown in FIGS. 1 to 3, the screws 70 consist of first screws 70F used for the first bus bar 60F and second screws 70S used for the second bus bar 60S. In the present embodiment, the first screw 70F and the second screw 70S have shapes and sizes same as each other. However, the first screw 70F and the second screw 70S may have shapes and sizes different from each other. As shown in FIG. 2, the screw 70 according to the present embodiment has a head 72 and a shaft 74. The shaft 74 extends from the head 72 in the Z-direction. In the XY-plane, the head 72 is larger than the fixing hole 62, while the shaft 74 is smaller than the fixing hole 62.

Figure 19:
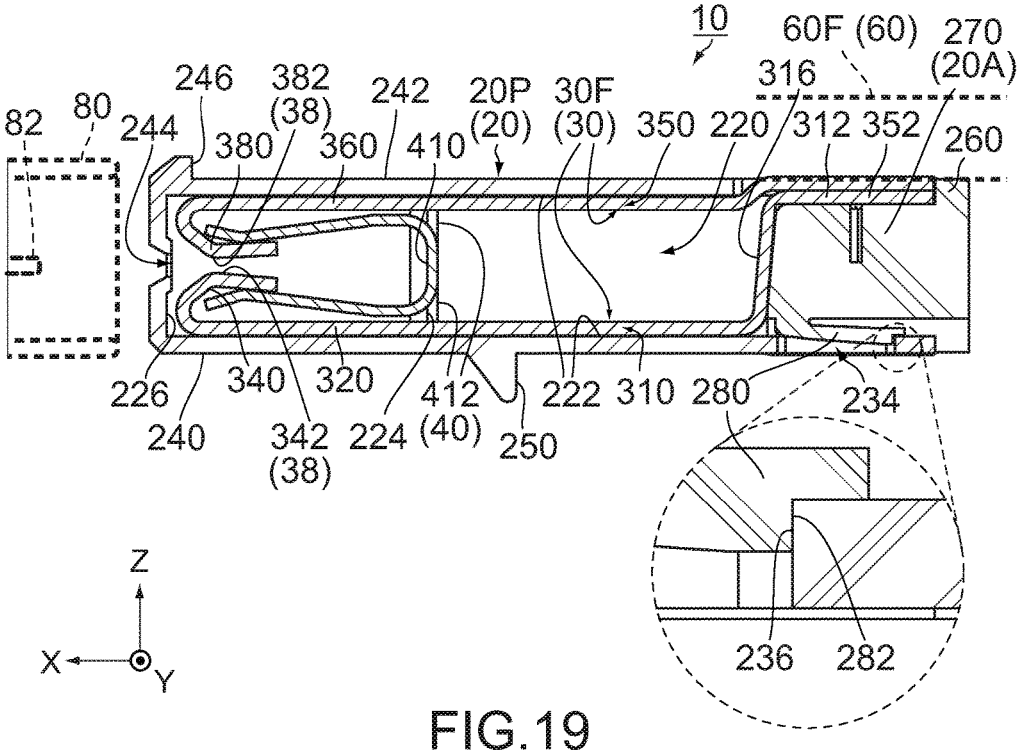
FIG. 19 is a cross-sectional view showing the connector of FIG. 14, taken along line XIX-XIX, wherein an outline of the first bus bar, to which the connector is fixed, and another outline of an end portion of a mating connector are illustrated in dashed line, and an engagement portion of the secondary member and therearound (part enclosed by dashed line) are enlarged to be illustrated.

As can be seen from FIG. 19, the connector 10 is mateable with a mating connector 80 along a mating direction (X-direction, front-rear direction) under the fixed state where the connector 10 is fixed to the bus bars 60. The mating connector 80 has a mating contact 82. For example, the mating contact 82 is connected to a connection object such as a circuit board (not shown) via a cable (not shown). The mating connector 80 according to the present embodiment is a plug, and the mating contact 82 is a plug contact extending in the X-direction. Moreover, the connector 10 according to the present embodiment is a receptacle. However, the present invention is also applicable to a plug. In other words, the connector 10 may be a plug, and the mating connector 80 may be a receptacle.

Figure 5:
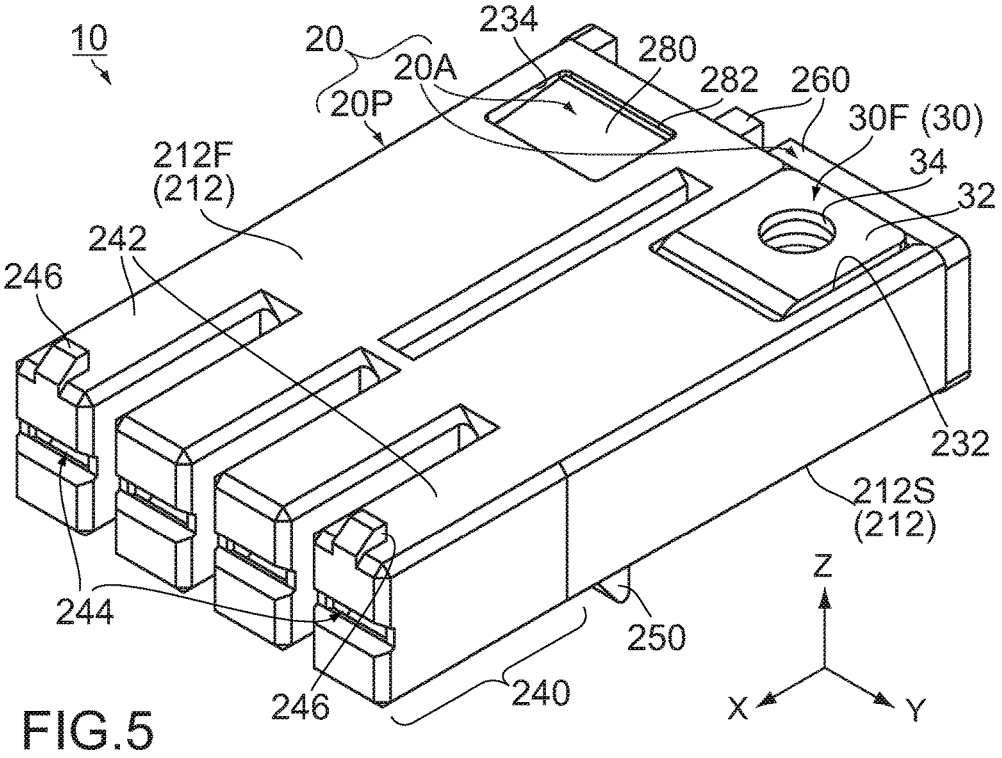
FIG. 5 is a perspective view showing the connector of FIG. 1.
Figure 6:
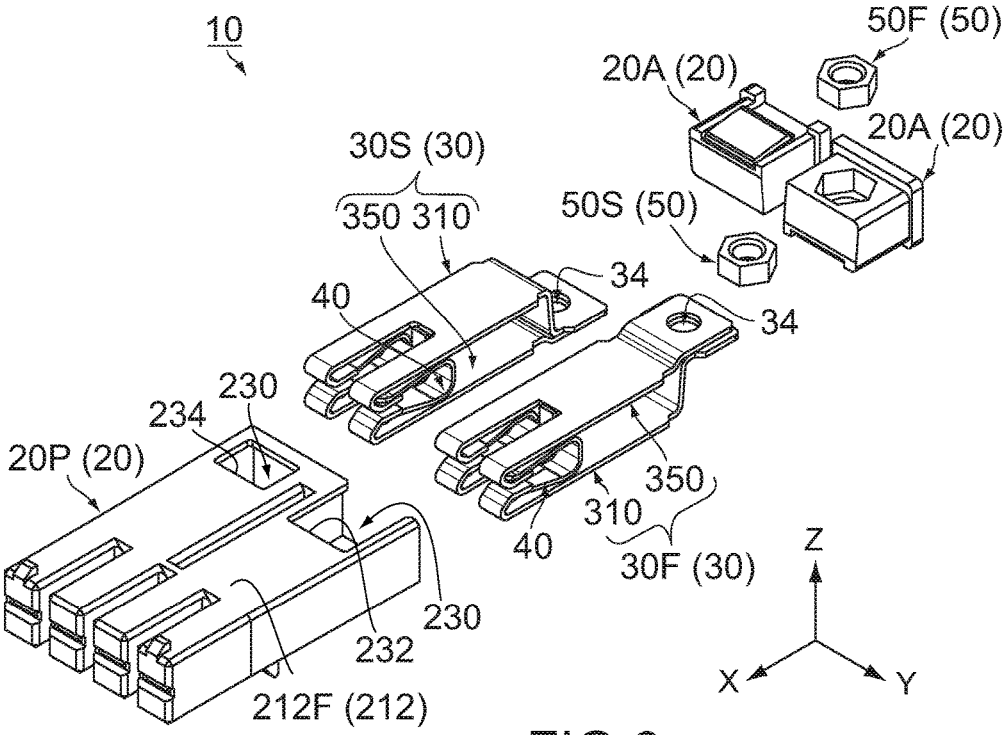
FIG. 6 is an exploded, perspective view showing the connector of FIG. 5.

Referring to FIGS. 5 and 6, the connector 10 comprises an accommodation member 20 made of insulator, two contacts 30 each made of conductor, two assistant springs 40 and two nuts 50. The contacts 30 according to the present embodiment consist of a first contact 30F and a second contact 30S. Moreover, the accommodation member 20 according to the present embodiment includes one primary member 20P and two secondary members 20A which are separable from each other. However, the connector 10 may be formed differently. For example, the two secondary members 20A of the accommodation member 20 may be formed integrally with each other. Moreover, the accommodation member 20 includes another member in addition to the primary member 20P and the secondary members 20A.

Figure 7:
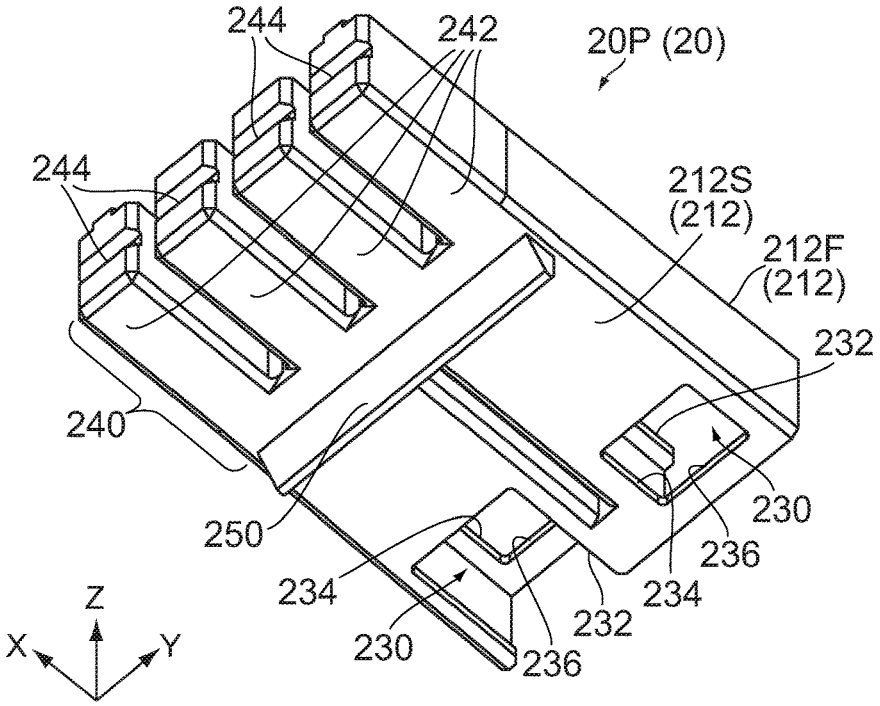
FIG. 7 is a lower perspective view showing a primary member of an accommodation member of the connector of FIG. 6.

As can be seen from FIGS. 5 and 7, the primary member 20P is a main member of the accommodation member 20. The primary member 20P of the accommodation member 20 has two attached surfaces 212, namely a first surface 212F and a second surface 212S, which are positioned opposite to each other in the Z-direction. Each of the attached surfaces 212 is a horizontal plane in parallel to the XY-plane. As shown in FIGS. 1 and 4, under the fixed state, the first surface 212F faces a lower surface, or the negative Z-side surface, of the first bus bar 60F, and the second surface 212S faces an upper surface, or the positive Z-side surface, of the second bus bar 60S.

As shown in FIGS. 6 and 7, the primary member 20P has a rear end, or the negative X-side end, formed with two receiving portions 230. The receiving portions 230 are spaces which receive the secondary members 20A, respectively, and are arranged in the Y-direction. Each of the attached surfaces 212 is formed with a cut 232 and an opening 234. The cut 232 is a cut by which the primary member 20P is cut forward, or in the positive X-direction, from the rear end thereof, and the opening 234 is a hole provided in the vicinity of the rear end of the primary member 20P. As shown in FIG. 7, the rear end of the opening 234 is formed with an engagement portion (engagement surface) 236 which is perpendicular to the X-direction.

As shown in FIG. 6, in the first surface 212F, the cut 232 is provided at a position corresponding to the positive Y-side receiving portion 230, and the opening 234 is provided at another position corresponding to the negative Y-side receiving portion 230. As shown in FIG. 7, in the second surface 212S, the cut 232 is provided at a position corresponding to the negative Y-side receiving portion 230, and the opening 234 is provided at another position corresponding to the positive Y-side receiving portion 230. Thus, the positive Y-side opening 234 and the negative Y-side opening 234 are positioned at opposite positions of the primary member 20P in the Z-direction, respectively, and the positive Y-side cut 232 and the negative Y-side cut 232 are positioned at opposite positions of the primary member 20P in the Z-direction, respectively. Each receiving portion 230 continues to the cut 232 at one of the opposite sides in the Z-direction and continues to the opening 234 at a remaining one of the opposite sides in the Z-direction.

As shown in FIG. 7, the second surface 212S of the primary member 20P of the accommodation member 20 has a rotation stopper 250 formed thereon. The rotation stopper 250 extends long in the Y-direction and protrudes outward in the Z-direction, or in the negative Z-direction. The rotation stopper 250 has a rear end formed with a surface perpendicular to the X-direction.

As shown in FIG. 4, a front part, or the positive X-side part which is positioned forward beyond the rotation stopper 250, of the primary member 20P of the accommodation member 20 is positioned outward of the bus bars 60 in the XY-plane under the fixed state. Referring to FIGS. 4 and 19, this front part works as a fit portion 240 which is to be mated with the mating connector 80. The fit portion 240 is positioned toward the mating connector 80 beyond the rotation stopper 250 in the X-direction. Moreover, the fit portion 240 projects beyond the bus bars 60 in the positive X-direction under the fixed state.

As shown in FIGS. 5 and 7, the fit portion 240 includes four projecting portions 242 each of which projects in the positive X-direction. As shown in FIG. 5, two of the projecting portions 242, which are positioned outside in the Y-direction, are formed with lock portions 246, respectively. Referring to FIG. 19, under a mated state where the connector 10 is mated with the mating connector 80, the lock portions 246 lock locked portions (not shown) of the mating connector 80, so that the mated state is maintained. However, the connector 10 does not always need to comprise the lock portions 246.

Figure 20:
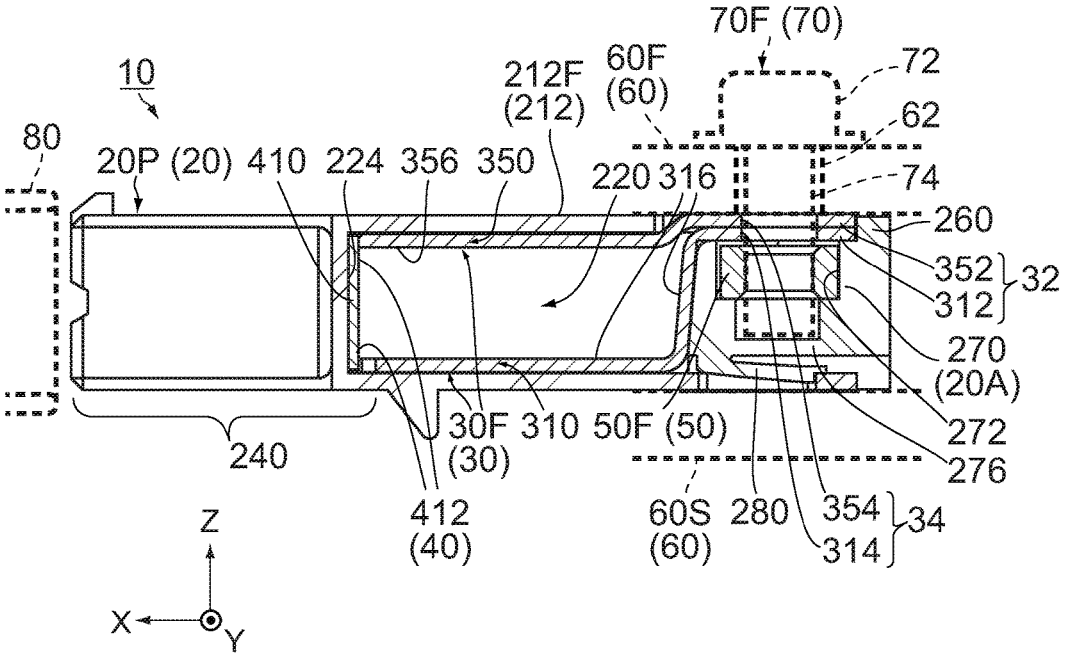
FIG. 20 is a cross-sectional view showing the connector of FIG. 14, taken along line XX-XX, wherein outlines of the bus bars, to which the connector is fixed, and another outline of a first screw are illustrated in dashed line.
Figure 21:
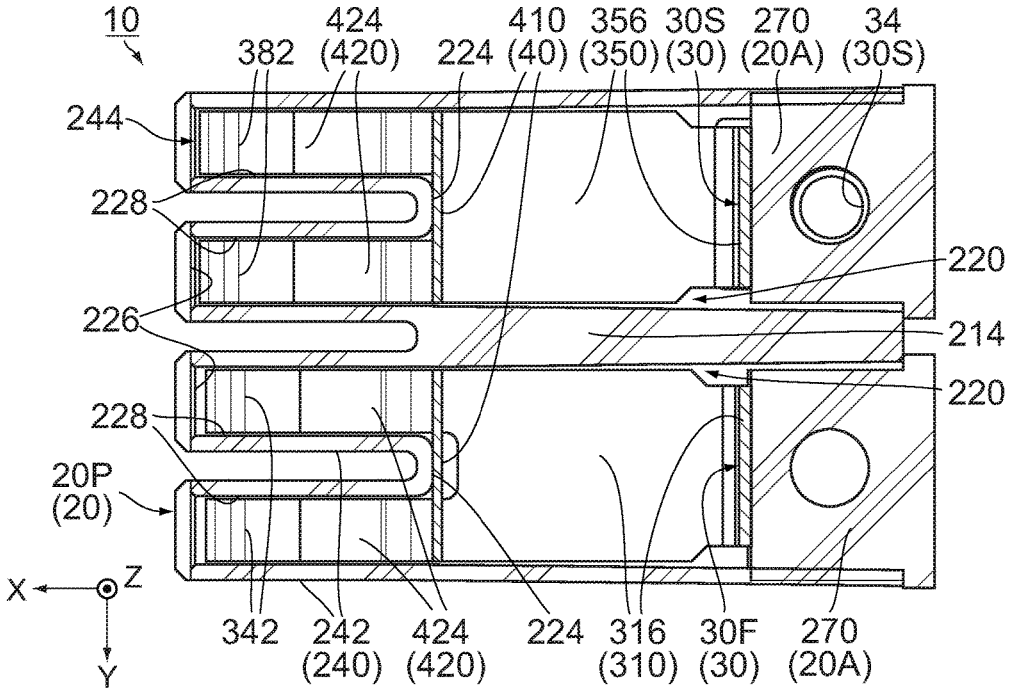
FIG. 21 is a cross-sectional view showing the connector of FIG. 18, taken along line XXI-XXI.

As shown in FIGS. 19 to 21, the primary member 20P has two accommodation portions 220 which are formed therewithin so as to correspond to the receiving portions 230 (see FIG. 7), respectively. The accommodation portions 220 are spaces which accommodate the two contacts 30, respectively, and are arranged in the Y-direction. According to the present embodiment, the accommodation portions 220 are separated from each other by a partition wall 214 (see FIGS. 14 and 15). The accommodation portions 220 have rear sides, or the negative X-sides, which continue to the receiving portions 230 (see FIG. 7), respectively. As shown in FIG. 21, each of the accommodation portions 220 has a front part which extends within two of the projecting portions 242. Referring to FIG. 19, each of the projecting portions 242 has a front end formed with an opening 244 which continues to the accommodation portion 220. As shown in FIGS. 5 and 7, the opening 244 according to the present embodiment extends in the Y-direction.

Referring to FIGS. 19 to 21, the accommodation portion 220 is provided with an upper side (positive Z-side) support wall 222, a lower side (negative Z-side) support wall 222, a middle wall 224, end walls 226 and sidewalls 228. As shown in FIG. 19, the support walls 222 extend in parallel to the XY-plane and define an upper end (positive Z-side end) and a lower end (negative Z-side end) of the accommodation portion 220. As shown in FIG. 21, the sidewalls 228 extend from the middle wall 224 toward the end wall 226. As shown in FIG. 19, the middle wall 224 extends between the upper support wall 222 and the lower support wall 222 in parallel to the YZ-plane. As shown in FIG. 21, the middle wall 224 is positioned between the two projecting portions 242 in the Y-direction and is positioned in the vicinity of the rear end of the fit portion 240 in the X-direction. The end walls 226 are positioned at the front end of the accommodation portion 220.

As shown in FIG. 6, each of the contacts 30 consists of a contact member 310 and a contact member 350. In the first contact 30F, the contact member 350 is arranged on, or toward the positive Z-side of, the contact member 310, and in the second contact 30S, the contact member 350 is arranged under, or toward the negative Z-side of, the contact member 310. In other words, the second contact 30S has an upside-down shape (inverted shape in the Z-direction) of the first contact 30F. Except for the aforementioned difference, the first contact 30F and the second contact 30S has an identical structure. Therefore, the following explanation about the structure of the first contact 30F can be applied to the second contact 30S by changing the directional description such as upper and lower in the Z-direction. Moreover, the following explanation about the contact 30 can be applied to each of the first contact 30F and the second contact 30S.

Figure 8:
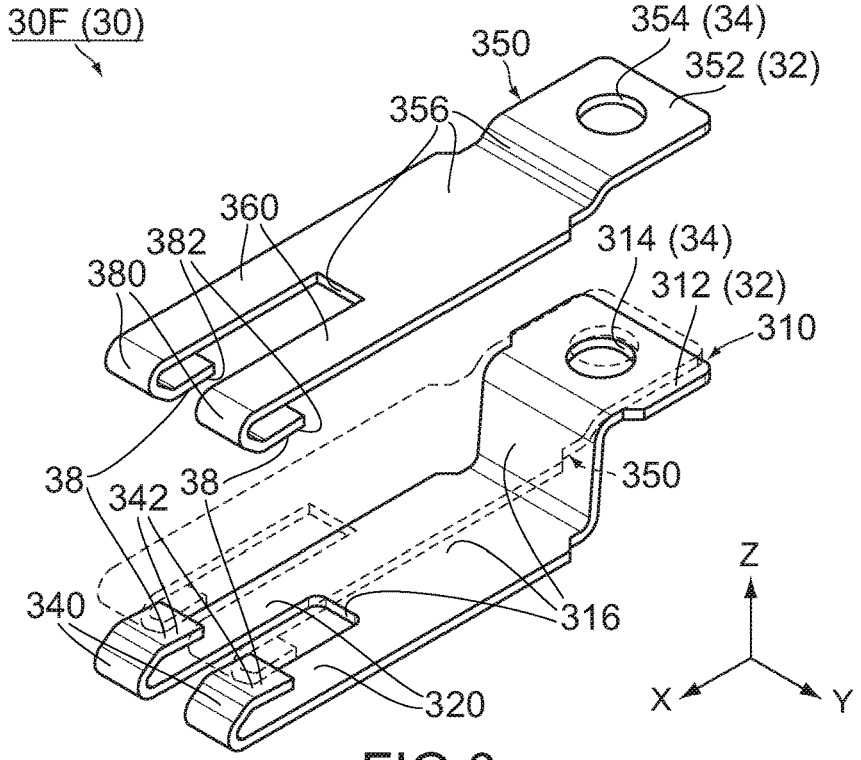
FIG. 8 is an upper perspective view showing two contact members of a first contact of the connector of FIG. 6, wherein the illustrated dashed line shows an outline of an upper contact member which is under a state where the contact members are combined to form the first contact.
Figure 9:
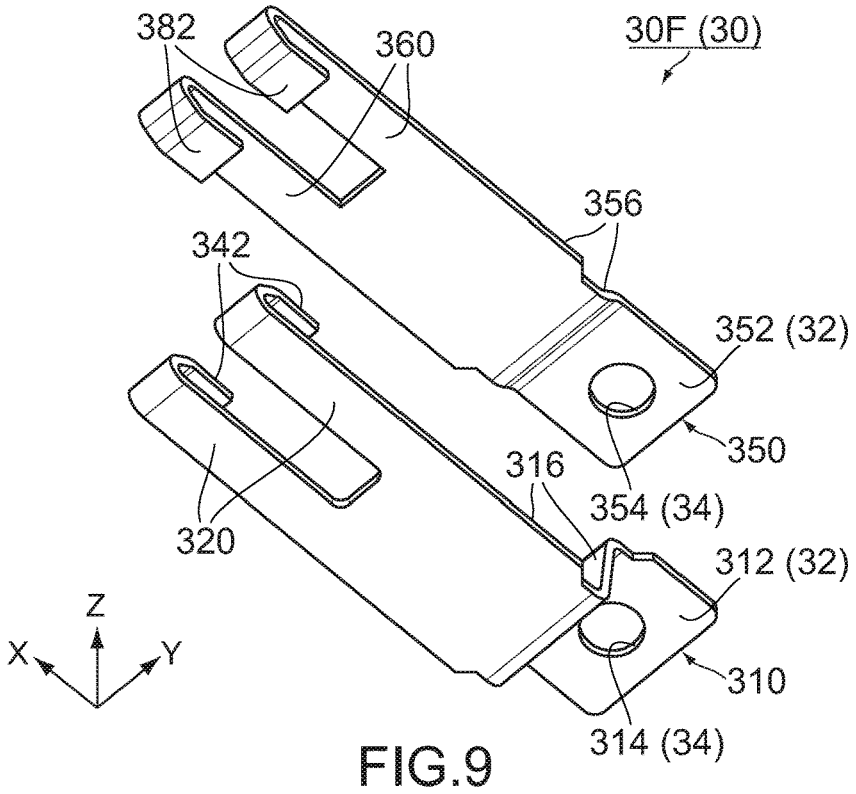
FIG. 9 is a lower perspective view showing the contact members of FIG. 8.

As can be seen from FIGS. 8 and 9, the contact member 310 and the contact member 350 of the first contact 30F are formed of bent metal plates, respectively, and have their respective portions which correspond to each other. In detail, the contact member 310 has a screwed portion 312, a coupling portion 316, two support portions 320 and two spring portions 340, and the contact member 350 has a screwed portion 352, a coupling portion 356, two support portions 360 and two spring portions 380.

The screwed portion 312 has a shape and size similar to that of the screwed portion 352 but is slightly larger than the screwed portion 352 in the Y-direction. Each of the screwed portion 312 and the screwed portion 352 has a flat-plate shape in parallel to the XY-plane. The screwed portion 312 is formed with a screw hole 314, and the screwed portion 352 is formed with a screw hole 354. The screw hole 314 and the screw hole 354 have shapes and sizes same as each other. The screw hole 314 and the screw hole 354 pass through the screwed portion 312 and the screwed portion 352 in the Z-direction, respectively.

The coupling portion 316 couples the screwed portion 312 to the support portions 320, and the coupling portion 356 couples the screwed portion 352 to the support portions 360. The coupling portion 316 largely extends downward, or in the negative Z-direction, from the screwed portion 312 and subsequently extends forward to the support portions 320. By contrast, the coupling portion 356 slightly extends obliquely downward from the screwed portion 352 and subsequently extends forward to the support portions 360.

The support portions 320 extend forward from the coupling portion 316, and the support portions 360 extend forward from the coupling portion 356. The coupling portion 316 has a front edge which is positioned between the support portions 320 in the Y-direction, and the coupling portion 356 has another front edge which is positioned between the support portions 360 in the Y-direction. In other words, the front edge of the coupling portion 316 extends in the Y-direction between the support portions 320, and the front edge of the coupling portion 356 extends in the Y-direction between the support portions 360.

The spring portions 340 extend from the support portions 320, respectively. Each of the spring portions 340 is bent upward (in the positive Z-direction) and rearward (in the negative X-direction). Similarly, the spring portions 380 extend from the support portions 360, respectively. Each of the spring portions 380 is bent downward and rearward. Each of the spring portions 340 has an upper end formed with a socket contact portion 342, and each of the spring portions 380 has a lower end formed with a socket contact portion 382.

As can be seen from FIG. 8, the contact member 350 are arranged on the contact member 310 so that the screw hole 314 and the screw hole 354 are positioned to each other. As can be seen from this arrangement, the contact 30 is a socket contact which includes the two contact members, namely the contact member 310 and the contact member 350. In particular, the contact 30 of the present embodiment consists of the two contact members. However, the contact 30 may be formed of three or more of the contact members. Instead, the contact 30 may be formed of only one contact member.

Figure 10:
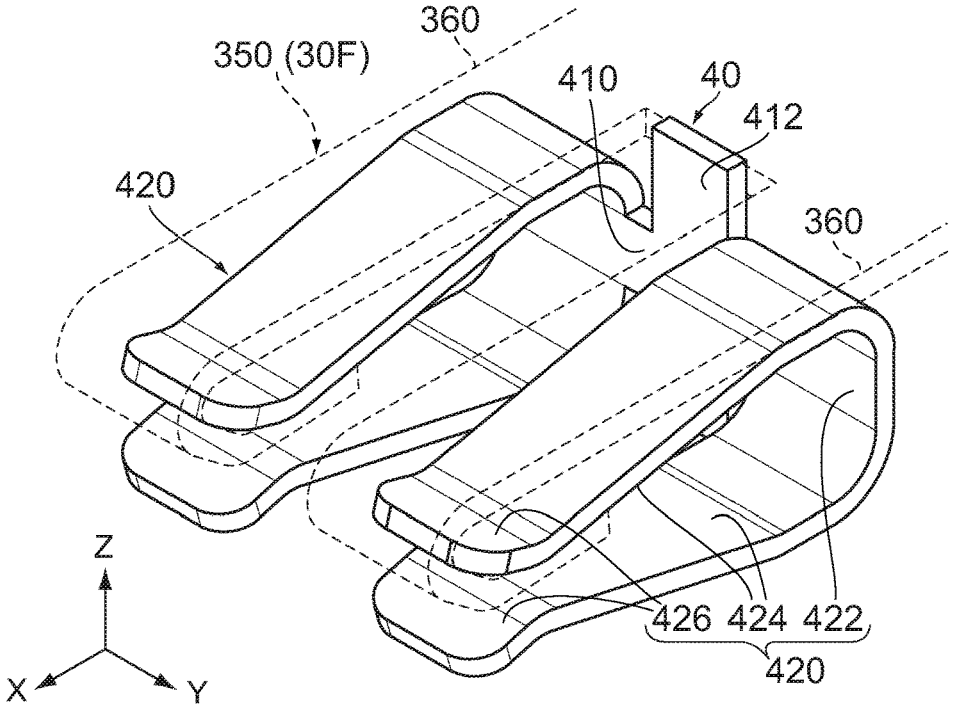
FIG. 10 is an upper perspective view showing an assistant spring of the connector of FIG. 6, wherein the illustrated dashed line shows end portions of the upper contact member of the first contact to which the assistant spring is to be attached.
Figure 11:
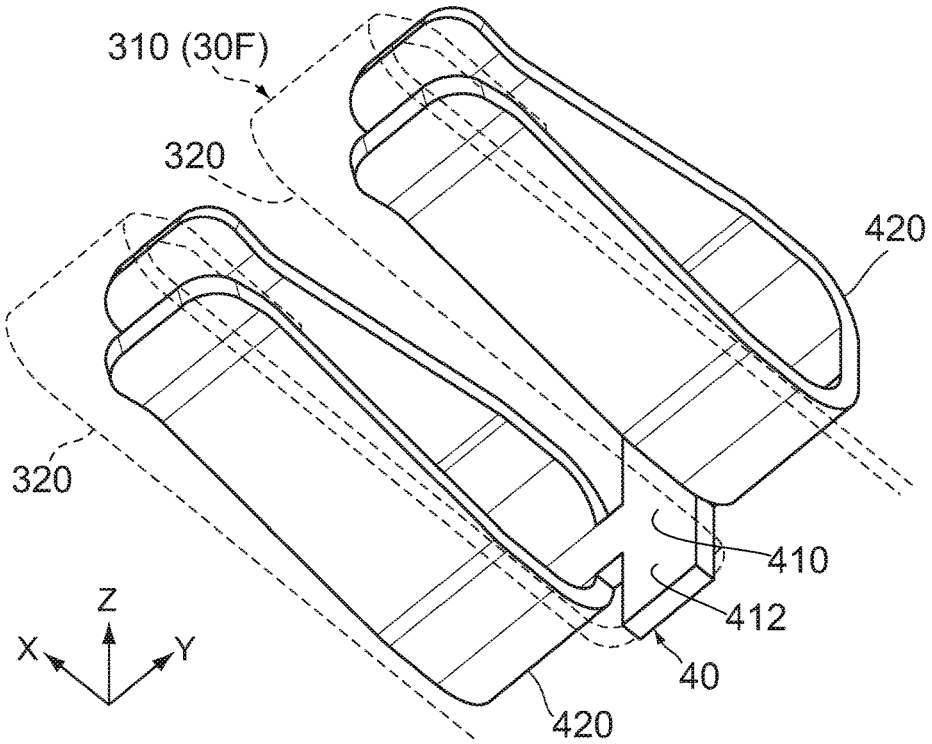
FIG. 11 is a lower perspective view showing the assistant spring of FIG. 10, wherein the illustrated dashed line shows end portions of a lower contact member to which the assistant spring is to be attached.

As can be seen from FIGS. 10 and 11, each of the assistant springs 40 has a vertically symmetrical shape. The assistant spring 40 has a coupling portion 410 and two clip portions 420. The coupling portion 410 couples the clip portions 420 to each other in the Y-direction. The coupling portion 410 is formed with two positioning portions 412. Each positioning portion 412 has a flat-plate shape in parallel to the YZ-plane. The positioning portions 412 extend upward and downward from the coupling portion 410, respectively.

Each of the clip portions 420 has a support portion 422 and two spring portions 424. The support portion 422 is connected to the coupling portion 410 and extends in parallel to the YZ-plane. The spring portions 424 extend forward, while slightly curved, from opposite ends of the support portions 422 in the Z-direction, respectively. Each of the spring portions 424 has an end portion 426. Each of the end portions 426 extends forward while sloping outward in the Z-direction. As can be seen from the above explanation, the spring portions 424 are resiliently deformable so as to change the distance therebetween in the Z-direction.

As shown in FIG. 6, the nuts 50 consists of a first nut 50F and a second nut 50S. The first nut 50F and the second nut 50S have shapes and sizes same as each other. Moreover, the two secondary members 20A have shapes and sizes same as each other. However, one of the secondary members 20A is used under an upside-down attitude relative to a remaining one of the secondary members 20A.

Figure 12:
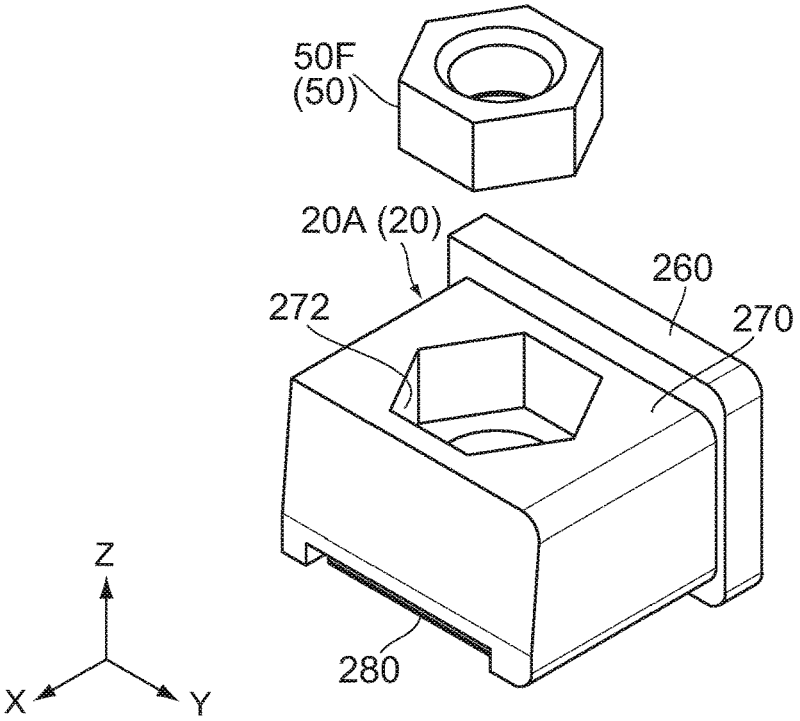
FIG. 12 is an upper perspective view showing a secondary member of the accommodation member and a nut of the connector of FIG. 6.
Figure 13:
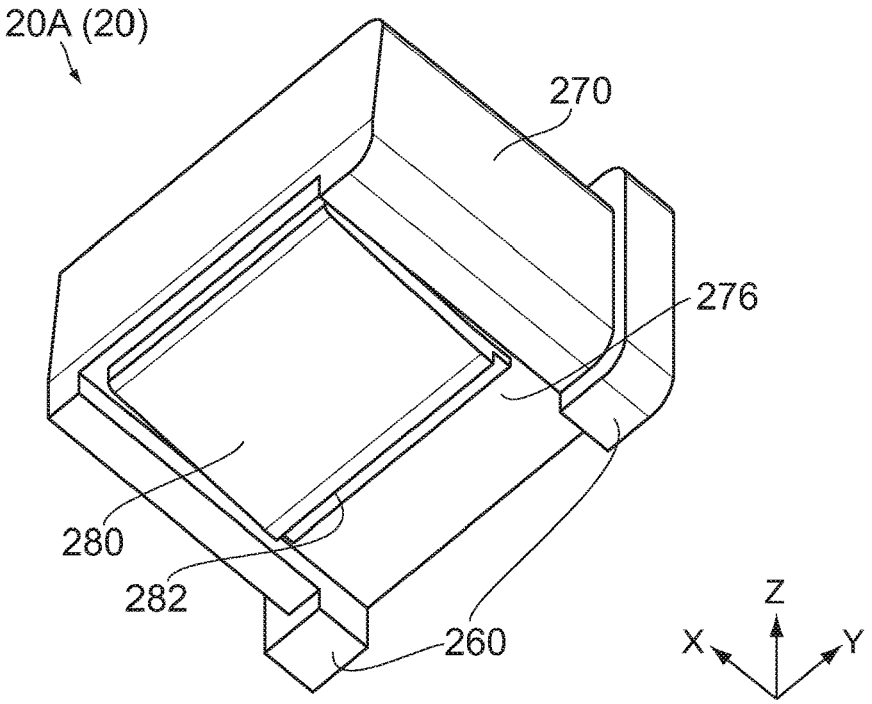
FIG. 13 a lower perspective view showing the secondary member of FIG. 12.

As shown in FIGS. 12 and 13, the secondary member 20A has an outer wall 260 and a body portion 270. The body portion 270 extends forward from the outer wall 260. As can be seen from FIGS. 5 and 7, in the YZ-plane, the outer wall 260 is larger than the receiving portion 230 of the primary member 20P, while the body portion 270 is slightly smaller than the receiving portion 230. Thus, the body portion 270 has a shape and size corresponding to the receiving portion 230.

As shown in FIG. 12, the body portion 270 is formed with a nut-accommodation portion 272. Therefore, the connector 10 (see FIG. 20) comprises the two nut-accommodation portions 272. The nut-accommodation portion 272 is a space which has a shape and size corresponding to the nut 50. In detail, in the XY-plane, the nut-accommodation portion 272 has a similar shape that is identical to or slightly larger than that of the nut 50. As can be seen from FIG. 20, the nuts 50 are accommodated in the nut-accommodation portions 272, respectively.

As shown in FIG. 13, the body portion 270 has a separation wall 276 and a spring plate 280. Therefore, the connector 10 (see FIG. 20) comprises the two separation walls 276.

As can be seen from FIGS. 12 and 13, the separation wall 276 forms a bottom of the nut-accommodation portion 272. As shown in FIG. 20, the body portion 270 has a hole which is formed between the nut-accommodation portion 272 and the separation wall 276 so that an end portion of the screw 70 can be received therewithin. As shown in FIG. 13, the spring plate 280 has a rectangular-plate shape. A front end of the spring plate 280 is connected to the vicinity of a front end of the separation wall 276, and a rear end of the spring plate 280 is slightly apart from the separation wall 276. The spring plate 280 is formed with an engagement portion (engagement surface) 282 which is positioned in the vicinity of the rear end thereof and intersects with the X-direction. The spring plate 280 is resiliently deformable so as to change its distance from the separation wall 276, so that the engagement portion 282 is movable in the Z-direction.

As can be seen from FIGS. 6 and 19 to 21, the contact 30 with the assistant spring 40 attached thereto is inserted into the accommodation portion 220 from the rear end of the primary member 20P through the receiving portion 230. Moreover, the secondary member 20A with the nut 50 accommodated therewithin is inserted into the receiving portion 230 so as to push the coupling portion 316 of the contact 30 into the accommodation portion 220. When the secondary member 20A is received in the receiving portion 230, the engagement portion 282 is engaged with the engagement portion 236. Meanwhile, the outer wall 260 of the secondary member 20A is in contact with or close to the rear end of the primary member 20P. This arrangement prevents the secondary member 20A from being moved forward and rearward, so that the body portion 270 is held within the receiving portion 230.

As can be seen from FIGS. 6 and 21, the accommodation member 20 accommodates the contacts 30, which are arranged in the Y-direction, within the accommodation portions 220, respectively. As can be seen from FIG. 19, according to the present embodiment, the secondary member 20A merely pushes the contact member 310 and the contact member 350 into the accommodation portion 220, so that the contact 30 can be accommodated at a predetermined position within the accommodation portions 220 with no need for the contact member 310 and the contact member 350 to be fixed to each other via welding, etc. or to be press-fit into the accommodation portion 220.

Referring to FIGS. 8 and 20, the screw hole 314 and the screw hole 354 of the contact 30 accommodated in the accommodation portion 220 are positioned at positions same as each other in the XY-plane and are arranged on each other in the Z-direction. As a result, each of the contacts 30 is formed with a screw hole 34 which passes through the contact 30 in the Z-direction. The screwed portion 312 and the screwed portion 352 of the contact 30 are stacked in the Z-direction, so that the contact 30 is formed with a screwed portion 32. Thus, each of the contacts 30 has the screwed portion 32 formed with the screw hole 34. The screw hole 34 overlaps with the hole of the nut 50 in the XY-plane.

Referring to FIG. 19, within the accommodation portion 220 of the accommodation member 20, the contact member 310 and the contact member 350 of the contact 30 extend in the X-direction while being apart from each other in the Z-direction. The end portion (spring portion 340) of the contact member 310 and the end portion (spring portion 380) of the contact member 350 are bent to be close to each other in the Z-direction. Because the support portion 320 of the contact member 310 and the support portion 360 of the contact member 350 are sufficiently apart from each other in the Z-direction, the spring portion 340 and the spring portion 380 can be bent as much as necessary.

As shown in FIGS. 10, 11 and 19, in each of the contacts 30, the assistant spring 40 is arranged between the contact member 310 and the contact member 350 in the Z-direction. Moreover, the assistant spring 40 is positioned at a position same as that of the contact 30 in the Y-direction. In detail, the assistant spring 40 is attached to the end portion (spring portion 340) of the contact member 310 and the end portion (spring portion 380) of the contact member 350 to couple the end portions to each other in the Z-direction. As can be seen from this structure, the assistant spring 40 reinforces the contact force of the contact 30 which is a socket contact. In detail, during the contact of the contact 30 with the mating contact 82, the spring portion 340 and the spring portion 380 are kept under a resiliently deformed state. As a result, the spring force (contact force) of the contact 30 might be gradually degraded. The degradation of the contact force can be prevented or reduced by the provision of the assistant spring 40. In order to more securely obtain this effect, the assistant spring 40 is preferred to be made of a material having superior stress relaxation characteristic, for example, stainless steel or copper-titanium alloy.

Referring to FIGS. 10, 11 and 21, one of the positioning portions 412 of the assistant spring 40 is positioned between the support portions 360 of the contact member 350 in the Y-direction, and a remaining one of the positioning portions 412 is positioned between the support portions 320 of the contact member 310 in the Y-direction.

As shown in FIGS. 19 to 21, the coupling portion 410 of the assistant spring 40 is in contact with or close to the middle wall 224 of the accommodation member 20 in the X-direction. One of the positioning portions 412 is positioned between the front end of the coupling portion 316 of the contact member 310 and the middle wall 224 in the X-direction. Moreover, a remaining one of the positioning portions 412 is sandwiched between the front end of the coupling portion 356 of the contact member 350 and the middle wall 224 in the X-direction. In other words, the assistant spring 40 is sandwiched between the contact 30 and the accommodation member 20, so that the assistant spring 40 is positioned at a predetermined position in the accommodation portion 220.

As shown in FIGS. 19 and 20, the screwed portion 312 of the contact member 310 and the screwed portion 352 of the contact member 350 are positioned forward of the outer wall 260 of the secondary member 20A in the X-direction. The coupling portion 316 of the contact member 310 is positioned forward of the body portion 270 of the secondary member 20A in the X-direction. Moreover, the coupling portion 356 of the contact member 350 is positioned rearward of the middle wall 224 of the primary member 20P in the X-direction. In other words, the contact 30 is sandwiched by the primary member 20P and the secondary member 20A, so that the contact 30 is positioned at a predetermined position in the accommodation portion 220.

Figure 14:
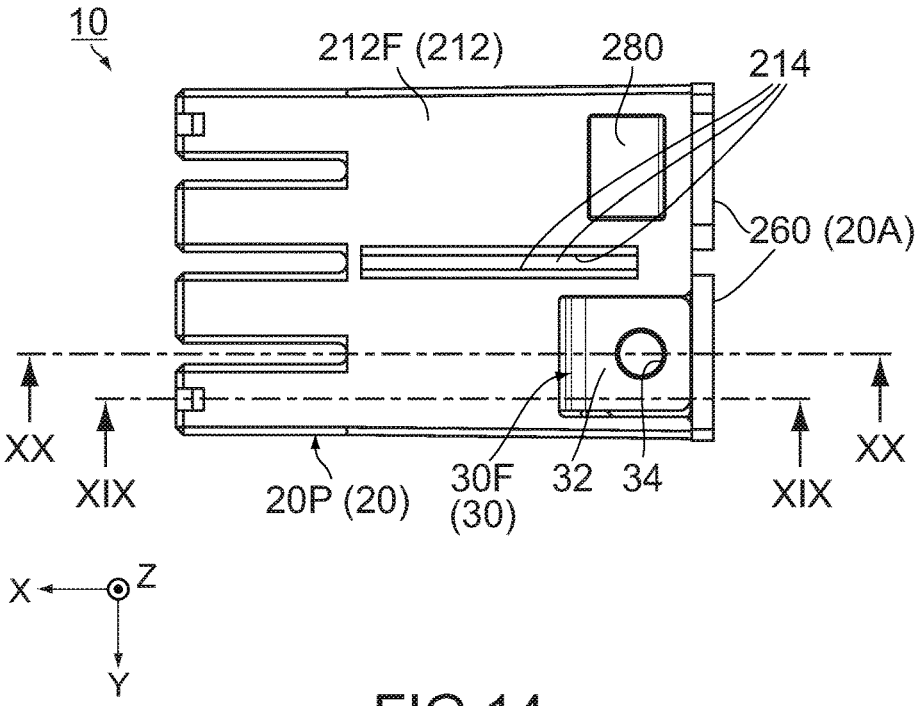
FIG. 14 is a top view showing the connector of FIG. 5.
Figure 15:
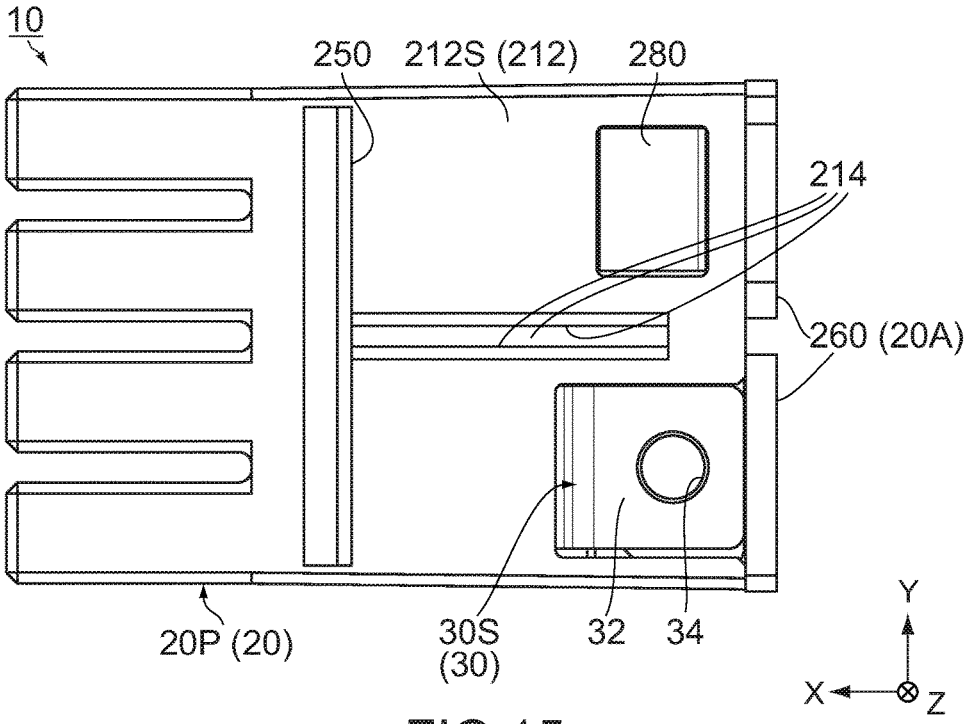
FIG. 15 is a bottom view showing the connector of FIG. 5.

As shown in FIGS. 6, 14 and 15, the screw holes 34 of the two contacts 30 are positioned at opposite sides of the connector 10 in the Z-direction, respectively. As can be seen from FIGS. 1 to 3, the thus-formed connector 10 can be fixed to the bus bars 60 by using the only two screws 70. In detail, the first screw 70F fixes the connector 10 to the first bus bar 60F, and the second screw 70S fixes the connector 10 to the second bus bar 60S.

Referring to FIG. 20, under the fixed state where the connector 10 is fixed to the bus bars 60, the contacts 30 are screwed to the bus bars 60 by the screws 70 inserted in the screw holes 34. In detail, under the fixed state, the first contact 30F is screwed to the first bus bar 60F by the first screw 70F inserted in the screw hole 34 from above. Further referring to FIGS. 3 and 6, the second contact 30S is screwed to the second bus bar 60S by the second screw 70S inserted in the screw hole 34 from below. As can be seen from the above explanation, the connector 10 according to the present invention can be easily fixed to the bus bars 60 by a simple operation in which the only two screws 70 screw the contacts 30 to the two bus bars 60.

Referring to FIGS. 3 and 4, when the connector 10 is screwed to the second bus bar 60S, the rotation stopper 250 prevents the connector 10 from being rotated. In the present embodiment, a plurality of the connectors 10 are screwed to the second bus bar 60S at first. Then, the plurality of the connectors 10 are temporarily fixed to the first bus bar 60F by the first screws 70F and subsequently screwed to the first bus bar 60F. Therefore, when the connector 10 is screwed to the first bus bar 60F, the connectors 10 and the second bus bar 60S are not rotated. According to the aforementioned fixing method, the first surface 212F of the accommodation member 20 does not need to be provided with the rotation stopper 250.

Referring to FIG. 5, the rotation stopper 250 of the accommodation member 20 may be provided not on the second surface 212S but on the first surface 212F. Moreover, the rotation stoppers 250 may be provided to both the first surface 212F and the second surface 212S, respectively, for some reason. In other words, the rotation stopper 250 may be formed on at least one of the first surface 212F and the second surface 212S. However, from a view point of making visual recognition of the arrangement of the connector 10 in the Z-direction easy, the rotation stopper 250 is preferred to be formed on only one of the first surface 212F and the second surface 212S.

Referring to FIG. 20, in the present embodiment, the contact 30 is screwed by the screw 70 and the nut 50. As shown in FIG. 12, because the nut 50 according to the present embodiment has a polygonal shape (specifically, a hexagonal shape) corresponding to the nut-accommodation portion 272, the nut 50 is not rotated upon screwing. As shown in FIG. 20, under the fixed state, the nut 50 is attached to the shaft 74 of the screw 70 which pierces the fixing hole 62 and the screw hole 34. The nut 50 and the head 72 of the screw 70 sandwich and fix the bus bar 60 and the contact 30 therebetween. However, the contact 30 may be screwed with no use of the nut 50. For example, the secondary member 20A may be provided with a screw hole instead of the nut-accommodation portion 272. This structure enables the number of the components of the connector 10 to be reduced. However, from a view point of more secure screwing of the contact 30, the structure like the present embodiment is preferable.

Referring to FIG. 20, in the present embodiment, the nut-accommodation portion 272 (i.e. necessary portion to screw the contact 30) is formed not in the primary member 20P but in the secondary member 20A. This formation enables the accommodation portion 220 to be opened rearward. As a result, the contact 30 and the assistant spring 40 can be easily accommodated in the accommodation portion 220 from behind.

Referring to FIG. 20, the separation wall 276 of one of the secondary members 20A is positioned under the screw hole 34. The separation wall 276 of a remaining one of the secondary members 20A (see FIG. 6) is positioned over the screw hole 34. In other words, each separation wall 276 forms a bottom of a space into which the shaft 74 of the screw 70 is to be inserted. Thus, the separation walls 276 cover the screw holes 34 in the XY-plane, respectively. As shown in FIGS. 14 and 15, when the connector 10 is seen along the Z-direction, only one of the screw holes 34 is visible.

Referring to FIG. 20, even if another screw (not shown), which is longer than the screw 70, is accidentally used, the end of the screw is not moved beyond the separation wall 276. Therefore, the spring plate 280 is prevented from being damaged. Moreover, the screw, which is inserted from one of the bus bars 60, is prevented from being brought into contact with a remaining one of the bus bars 60. According to the present embodiment, the separation walls 276 are provided, so that the bus bars 60 can be prevented from being short-circuited.

Figure 17:
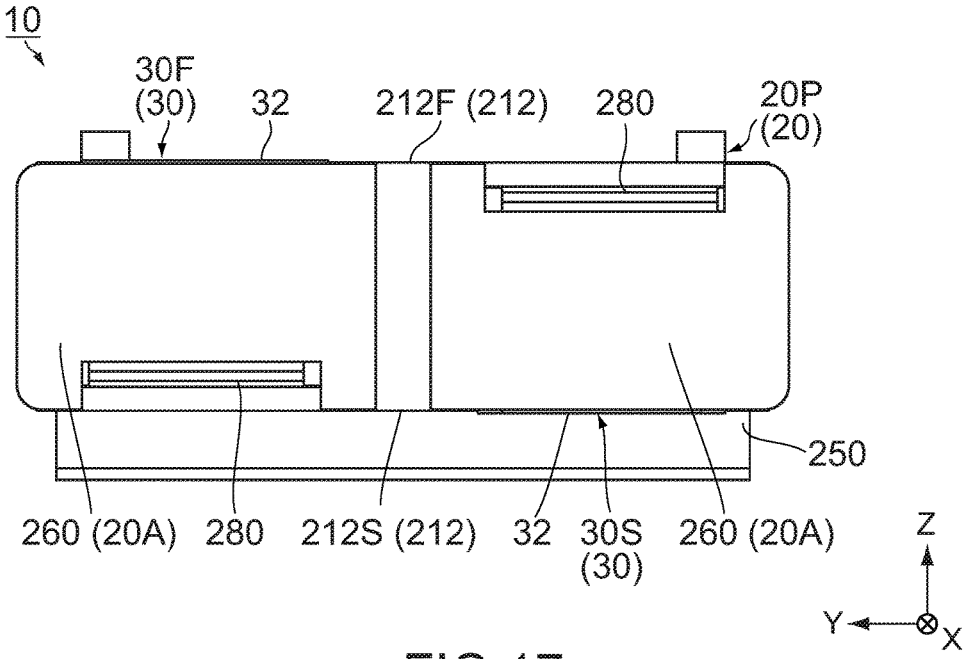
FIG. 17 is a rear view showing the connector of FIG. 5.
Figure 18:
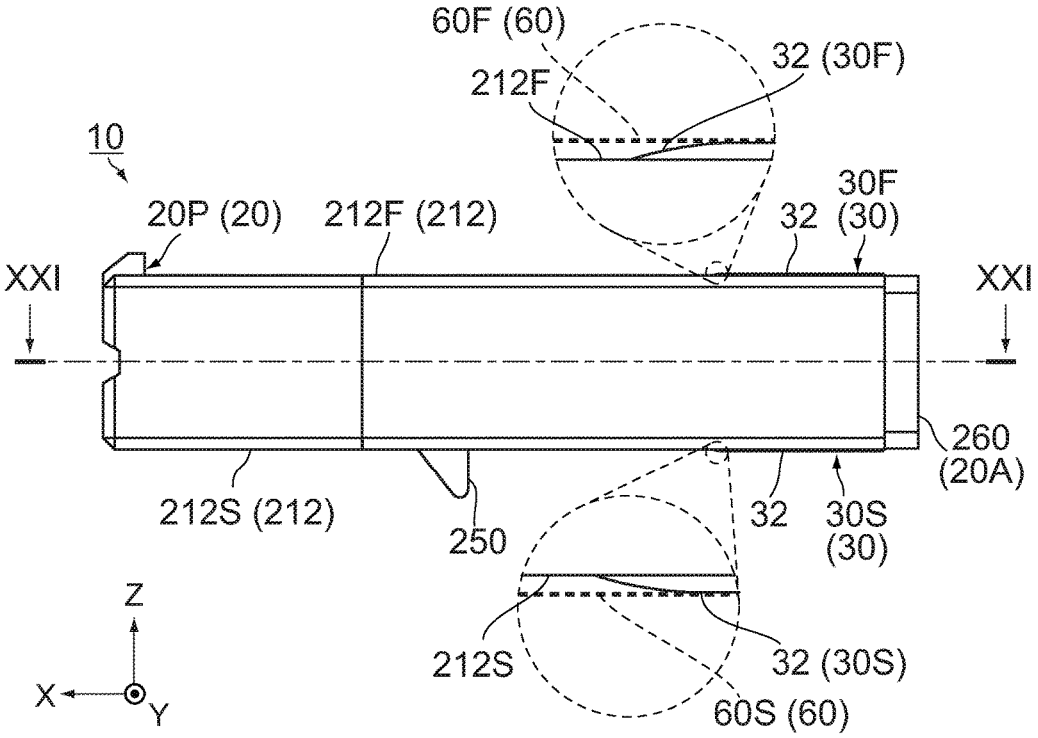
FIG. 18 is a side view showing the connector of FIG. 5, wherein a part of a screwed portion of the first contact and another part of a screwed portion of a second contact are enlarged to be illustrated in dashed circles together with outlines of the bus bars.

As shown in FIGS. 17 and 18, the screwed portion 32 of the contact 30 slightly projects outward of the connector 10 beyond the attached surface 212. In detail, the screwed portion 32 of the first contact 30F projects outward (upward) beyond the first surface 212F in the Z-direction. The screwed portion 32 of the second contact 30S projects outward (downward) beyond the second surface 212S in the Z-direction. Therefore, under the fixed state, the screwed portion 32 of the contact 30 is brought into contact with and electrically connected with the bus bar 60. In detail, under the fixed state, the screwed portion 32 of the first contact 30F is in direct contact with the first bus bar 60F, and the screwed portion 32 of the second contact 30S is in direct contact with the second bus bar 60S.

Under the fixed state, the screwed portion 32 of the contact 30 may be flush with the attached surface 212 in the Z-direction. In detail, the screwed portion 32 of the first contact 30F may be flush with the first surface 212F in the Z-direction. Similarly, the screwed portion 32 of the second contact 30S may be flush with the second surface 212S in the Z-direction. In other words, the outside surface of the screwed portion 32 of the first contact 30F may be positioned at a position same as that of the first surface 212F in the Z-direction, and the outside surface of the screwed portion 32 of the second contact 30S may be positioned at a position same as that of the second surface 212S in the Z-direction. Moreover, according to the present embodiment, the screwed portion 32 is moved toward the bus bar 60 when screwed to the bus bar 60. Therefore, the screwed portion 32 may be positioned inside of the connector 10 before screwed. However, from a view point of secure connection of the contact 30 to the bus bar 60, the screwed portion 32 is preferred to project from the attached surface 212 under the fixed state. Further referring to FIGS. 1 and 3, from another view point of stable hold of the connector 10 between the bus bars 60, the screwed portion 32 is preferred not to largely project from the attached surface 212.

Referring to FIG. 19, the contact 30, which is a socket contact, has the two socket contact portions, namely the socket contact portion 342 and the socket contact portion 382. According to the present embodiment, the socket contact portion 342 and the socket contact portion 382 are positioned opposite to each other in the Z-direction and positioned at positions same as each other in the X-direction.

Figure 16:
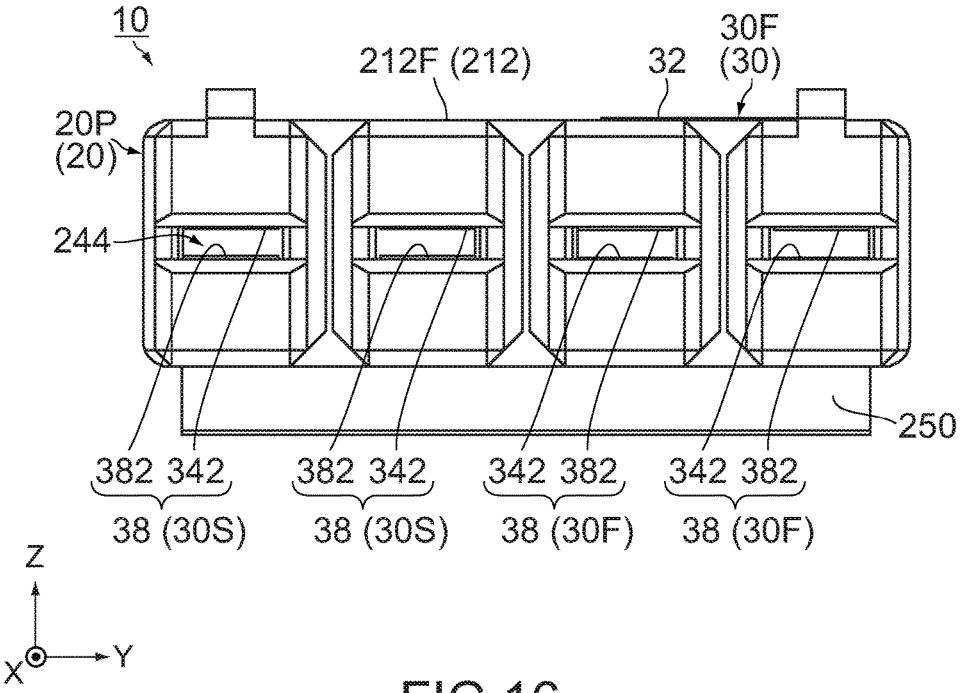
FIG. 16 is a front view showing the connector of FIG. 5.

Referring to FIG. 16, the socket contact portion 342 and the socket contact portion 382 form a contact portion 38 of the contact 30. In the present embodiment, each of the contacts 30 has two of the contact portions 38 which are apart from each other in the Y-direction. The two contact portions 38 of the contact 30 may be connected to a single connection object (not shown) via two of the mating connectors 80 (see FIG. 19) and two cables (not shown). In this connection, a cable which is relatively slender and easily wired can be used. Moreover, the two contact portions 38 of the contact 30 may be connected to two connection objects, respectively.

As can be seen from the above explanation, according to the present embodiment, flexibility of connection between the connector 10 and the connection object can be improved. From a view point of further improvement of flexibility of connection, each of the contacts 30 may have three or more of the contact portions 38 which are apart from one another in the Y-direction. From another view point of reduction of the size of the connector 10 in the Y-direction, each of the contacts 30 may have only one of the contact portions 38.

Referring to FIGS. 1 to 4, a plurality of the connectors 10 can be arranged in the Y-direction and fixed to the bus bars 60. In this arrangement, for example, direct-current power, which is supplied to the bus bars 60 from the AC-DC converter (not shown), can be distributed to various connection objects (not shown) each of which works with use of the direct-current power, so that energy consumption can be reduced. Moreover, when the connector 10 is fixed to the bus bars 60, the bus bars 60 are apart from each other by a distance that is equal to the size (thickness) of the connector 10 in the Z-direction. Therefore, only by fixing the connector 10 to the bus bars 60, the two bus bars 60, which have electric potential different from each other, can be kept apart from each other by a sufficient distance. In other words, the thickness of the connector 10 may be designed depending on the potential difference between the bus bars 60.

The present invention can be variously modified and applied in addition to the present embodiment and modifications which are explained above.

Figure 22:
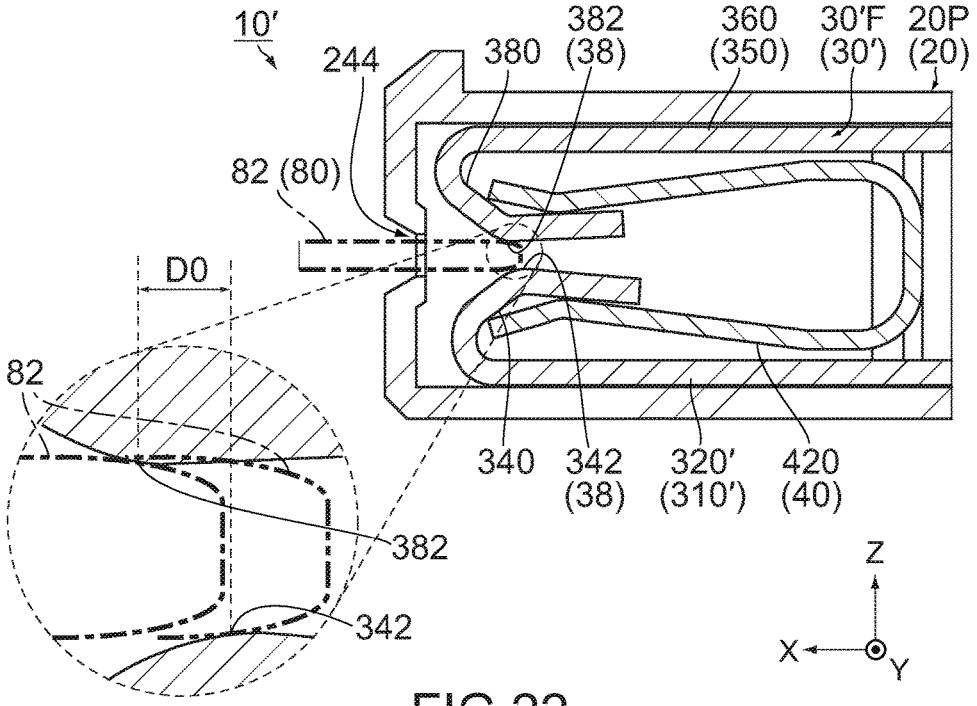
FIG. 22 is a cross-sectional view showing a part of a modification of the connector of FIG. 19, wherein socket contact portions of the connector and therearound (part enclosed by dashed line) are enlarged to be illustrated, and outlines of an end portion of the mating contact of the connector are illustrated in chain dotted line and two-dot chain line.
Figure 23:
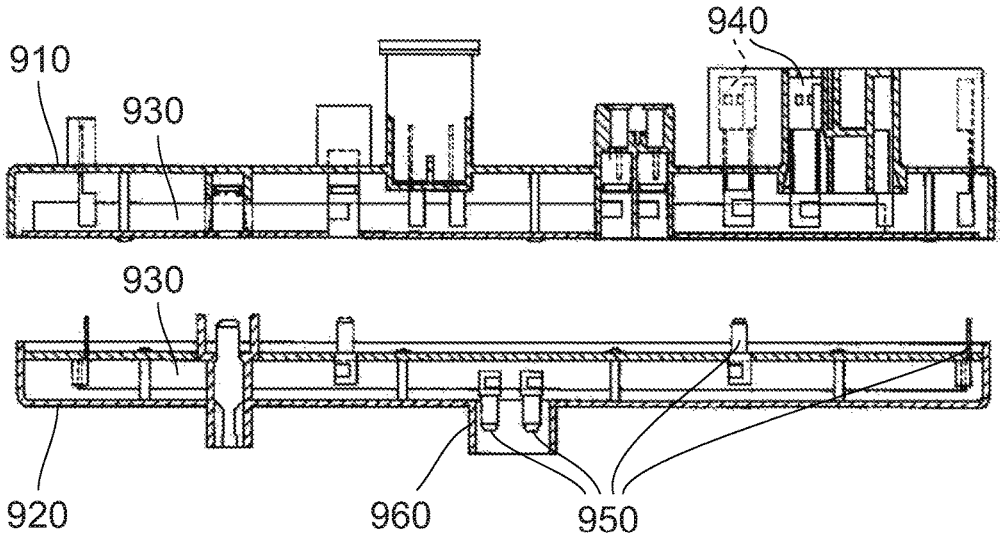
FIG.23 (PRIOR ART)
FIG. 23 is a cross-sectional view showing an electric connection case of Patent Document 1.

Referring to FIG. 22 together with FIG. 19, a connector 10' comprises a first contact 30'F (contact 30') which is slightly different from the first contact 30F. The first contact 30'F has a contact member 310' which is slightly different from the contact member 310 of the contact 30. The contact member 310' has a support portion 320'. The support portion 320' has a size in the X-direction which is slightly smaller than another size of the support portion 360 in the X-direction. Therefore, the socket contact portion 342 is apart from and positioned rearward of the socket contact portion 382 by a distance DO in the X-direction. When the connector 10', which comprises the contacts 30', is mated with the mating connector 80, the mating contact 82 is first brought into contact only with the socket contact portion 382. The mating contact 82 is brought into contact with the socket contact portion 342 after the socket contact portion 382 is slightly moved upward. This process reduces the peak of the insertion force of the mating contact 82.

Referring to FIG. 6, the first contact 30F and the second contact 30S may have shapes different from each other. Moreover, for example, the two secondary members 20A may have shapes different from each other. However, from a view point of reduction of the number of the types of the components, the structure according to the present embodiment is preferable.

The present application is based on both a Japanese patent application of JP2014-153465 filed on Jul. 29, 2014 before the Japan Patent Office, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

The invention claimed is:

1. A connector which is fixable to two bus bars consisting of a first bus bar and a second bus bar having electric potentials different from each other and which is mateable with a mating connector along a mating direction under a fixed state where the connector is fixed to the bus bars, wherein:

the connector comprises an accommodation member made of insulator and two contacts consisting of a first contact and a second contact;

the accommodation member has a first surface and a second surface which are positioned opposite to each other in a predetermined direction perpendicular to the mating direction;

the accommodation member accommodates the contacts which are arranged in a pitch direction perpendicular to both the mating direction and the predetermined direction;

each of the contacts has a screwed portion formed with a screw hole;

under the fixed state, the screwed portion of the first contact is flush with the first surface in the predetermined direction or projects outward beyond the first surface in the predetermined direction, and the screwed portion of the second contact is flush with the second surface in the predetermined direction or projects outward beyond the second surface in the predetermined direction;

under the fixed state, the first contact is screwed to the first bus bar by a first screw inserted in the screw hole thereof, and the second contact is screwed to the second bus bar by a second screw inserted in the screw hole thereof; and under the fixed state, the screwed portion of the first contact is in direct contact with the first bus bar, and the screwed portion of the second contact is in direct contact with the second bus bar.

2. The connector as recited in claim 1, wherein:

the connector further comprises two separation walls;

the separation walls cover the screw holes, respectively, in a plane perpendicular to the predetermined direction; and when the connector is seen along the predetermined direction, only one of the screw holes is visible.

3. The connector as recited in claim 1, wherein:

the connector further comprises two nuts;

each of the bus bars is formed with a fixing hole;

each of two screws, which consist of the first screw and the second screw, has a head and a shaft; and under the fixed state, the nut is attached to the shaft of the screw which pierces the fixing hole and the screw hole, and the nut and the head of the screw sandwich and fix the bus bar and the contact therebetween.

4. The connector as recited in claim 3, wherein:

the connector further comprises two nut-accommodation portions;

the nut-accommodation portions have shapes corresponding to the nuts, respectively; and the nuts are accommodated in the nut-accommodation portions, respectively.

5. The connector as recited in claim 4, wherein:

the accommodation member includes a primary member and a secondary member which are separable from each other;

the contact is sandwiched by the primary member and the secondary member; and the secondary member is formed with the nut-accommodation portion.

6. The connector as recited claim 1, wherein each of the contacts has two or more contact portions which are apart from one another in the pitch direction.

7. The connector as recited in claim 1, wherein:

each of the contacts is a socket contact which includes two contact members;

within the accommodation member, the contact members extend in the mating direction while being apart from each other in the predetermined direction; and end portions of the contact members are bent to be close to each other.

8. The connector as recited in claim 7, wherein:

the connector further comprises an assistant spring; and the assistant spring is attached to the end portions of the contact members and couples the end portions in the predetermined direction.

9. The connector as recited in claim 8, wherein the assistant spring is sandwiched between the socket contact and the accommodation member.

10. The connector as recited in claim 7, wherein:

the socket contact has two socket contact portions; and the socket contact portions are positioned opposite to each other in the predetermined direction and positioned at positions different from each other in the mating direction.

11. The connector as recited in claim 1, wherein one the first surface and the second surface of the accommodation member has a rotation stopper which is formed thereon and protrudes outward in the predetermined direction.

12. The connector as recited in claim 11, wherein a fit portion of the connector, which is to be mated with the mating connector, projects from the bus bars in the mating direction under the fixed state.

13. The connector as recited in claim 12, wherein the fit portion is positioned toward the mating connector beyond the rotation stopper in the mating direction.

* * * * *